US006066290A

United States Patent [19]

Dennis et al.

[11] Patent Number: 6,066,290

[45] Date of Patent: May 23, 2000

[54] METHOD AND APPARATUS FOR TRANSPORTING GREEN WORK PIECES THROUGH A MICROWAVE SINTERING SYSTEM

[75] Inventors: Mahlon Denton Dennis, Kingwood, Tex.; Rustum Roy; Dinesh Agrawal, both of State College, Pa.; Paul Gigl, Lemont, Pa.

[73] Assignees: The Pennsylvania State Research Foundation, University Park, Pa.; Dennis Tool Co., Houston, Tex.

[21] Appl. No.: 09/246,077

[22] Filed: Feb. 5, 1999

Related U.S. Application Data

[63] Continuation-in-part of application No. 08/730,222, Oct. 15, 1996, Pat. No. 5,848,348, and a continuation-in-part of application No. 08/687,870, Jul. 26, 1996, Pat. No. 6,004, 505.

[51] Int. Cl.[7] ..... B22F 3/12

[52] U.S. Cl. ..... 419/38; 419/54; 266/249

[58] Field of Search ..... 419/54, 38; 266/249

[56] References Cited

U.S. PATENT DOCUMENTS

| | | | |
|---|---|---|---|
| 4,501,717 | 2/1985 | Tsukamoto et al. | 419/58 |
| 4,938,673 | 7/1990 | Adrian | 419/23 |
| 5,653,775 | 8/1997 | Plovnick et al. | 51/309 |
| 5,848,348 | 12/1998 | Dennis | 419/5 |

FOREIGN PATENT DOCUMENTS

| | | |
|---|---|---|
| 40652A1 | 6/1988 | Germany . |
| 9633830 | 10/1996 | Germany . |
| 9634513 | 10/1996 | Germany . |

OTHER PUBLICATIONS

Iron Aluminide–Titanium Carbide Composites by Pressureless Melt Infiltration–Microstructure and Mechanical Properties, R. Subramanian, J.H. Schneibel, K.B. Alexander and K.P. Plucknett Metals and Ceramics Division, Oak Ridge National Laboratory, Oak Ridge, TN, Scripts Materialia, vol. 35, No. 5, pp. 583–588, 1996, Elsevier Science Ltd.

Bonding of WC with an Iron Aluminide (FeAl) Intermetallic, Joachim H. Schneibel and Ramesh Subramanian, Metals and Ceramics Division, Oak Ridge National Laboratory, Oak Ridge, TN—To be published in 1996 World Congress on Powder Metallurgy & Particulate Materials Jun. 16–21, Washington, D.C., pp. 1–9.

Iron Aluminide–Bonded Ceramics, Joachim H. Schneibel, Metals and Ceramics Division, Oak Ridge Natinal Laboratory, Oak Ridge, TN, undated.

*Microwave Processing of Ceramic Materials*, Howard H. Sutton, Ceramic Bulletin, vol. 68, No. 2, 1989, United Technologies Research Center, East Harford, CT PP. 376–386.

*The Inhibition of WC Grain Grow During Sintering of Nanostructured WC–Co Powder Compacts*, L.E. McCandlish, P. Seegopaul and R.K. Sadangi, Nanodyn Incorporated, 19 Home News Row, New Brunswick, NJ 08901, PP. 1–4.

*Microwave Sintering of Multiple Alumina and Composite Components*, Joel D. Katz and Rodger D. Blake, Los Alamos National Laboratory, Los Alamos, New Mexico 87545, Ceramic Bulletin, vol. 8, 1991, PP. 1304–1308.

*Primary Examiner*—Daniel J. Jenkins
*Attorney, Agent, or Firm*—Gunn & Associates, P.C.

[57] ABSTRACT

This disclosure sets forth a method and apparatus for microwave processing of green work pieces. Typically, individual green work pieces are formed in a small mold cavity crucible, and individual crucibles are then indexed into and out of a tube for a controlled transit time along the tube. The tube extends in one embodiment through a preheater and then into the microwave cavity, the preheater providing an initial heating step to change the rate of absorption of microwave energy so that microwave sintering is accomplished in the cavity.

24 Claims, 3 Drawing Sheets

42
40
20
22
30
16
24
28
14
18
12
25
28
26
32
10
34
36
20
44
46
48

METHOD AND APPARATUS FOR TRANSPORTING GREEN WORK PIECES THROUGH A MICROWAVE SINTERING SYSTEM

This disclosure is a continuation-in-part of application Ser. No. 08/730,222 which was filed Oct. 15, 1996 now U.S. Pat. No. 5,848,348 and also Ser. No. 08/687,870 filed Jul. 26, 1996 now U.S. Pat. No. 6,004,505.

BACKGROUND OF THE DISCLOSURE

As set out in the parent application, microwave sintering is believed to be effective for conversion of loose particulate material which is packed into a small mold. It is especially useful in the manufacture of cast devices which are sufficiently small to fit in the microwave sintering process. Examples of devices which benefit from microwave sintering and which are especially enhanced by such sintering techniques include drill bit inserts. While many examples could be noted, this is an especially important device for microwave sintering. A typical drill bit insert measures about ½ inch in diameter and has a length of about 1 inch. At one end, it is normally formed of tungsten carbide particles supported in a softer metal alloy which normally is formed of a number of metals but especially featuring cobalt. At the exposed or cutting end of the insert, the tungsten carbide sintered body is then capped with a diamond particle layer. It is secured in place by a cobalt alloy matrix. Quick heating and cooling is important to the fabrication of this composite structure. Different quantities of cobalt are used to form the tungsten carbide (WC hereinafter) body of the drill bit insert while the diamond crown has a different level of cobalt in it. The crown is normally called a polycrystalline diamond compact or PDC. The PDC capped WC body is later inserted into an opening formed in the body of the drill bit. This is fastened in place in an interference fit, i.e., the hole is smaller than the outside diameter of the cylindrical insert, or brazed in place.

If heated with conventional sintering techniques, the heat is maintained for sufficiently long intervals that grain growth occurs. This damages the structural integrity of the completed product. Worse than that, it provides a less than acceptable cobalt alloy dispersion in the different regions. This is undesirable in all aspects.

Sintering by microwave achieves modification of the grain boundaries and also accomplishes the sintering in such a short time interval that the alloy integrity is unchanged. In fact, the finished product exhibits more desirable characteristics. Sintering, in this particular instance, is directed to the fabrication of loose particulate materials into a solid member having structurally sintered yet different regions. This sintering process reduces or avoids multiple intermediate sintering steps otherwise involved in separate WC and PDC components. It also reduces or eliminates the stress that is involved in attaching the PDC layer to the WC component.

Prior to manufacture, the constituent parts of the drill bit insert are powders. They are loosely packed in a mold at a nominal pressure. They are joined together in the mold either by a slight amount of moisture but preferably with a sacrificial wax. This provides just enough adhesive benefit to hold the particles together. During sintering, the wax is driven off in the form of a combustible gas. If the volume is sufficient, the gas can be combusted for easy disposal after it has been vaporized. However, it is not involved in the heating process itself; rather, it is involved in initially adhering the particles together so that they maintain structural integrity at the time of molding and from molding through sintering. The finished products hold together as a result of the sintering process; the sintered drill bit insert has structural integrity as a result of the hard particles and the metal alloy binder which holds them together.

The amount of sintering can be controlled in making a sintered product by simply turning the microwave source off, first placing the unsintered green molded product in the microwave cavity and then turning it on. The present disclosure sets forth a process which is advanced over that. The microwave generator is turned on and left on. An elongate tube, hollow and having a circular cross-section in the preferred form, extends through the microwave cavity and is able to process a series of individual molded green inserts. They are assembled in individual molds. The molds provide structural definition to the profile and hold the particulate ingredients together in the desired profile and shape. That shape is held during the sintering process. Each mold is preferably identical in size and shape to the others so that they can be serially pushed or dropped by gravity through the tube in the microwave cavity. By controlling the velocity, the dwell time of each mold, and, hence, each insert in the cavity can be controlled. By controlling the velocity and the dwell time, the microwave sintering equipment is then simply switched on and left on so long as individual molds are sequentially put into and taken out of the sintering furnace.

The pathway for an individual mold is thus along a conveyor tube. They are introduced at the same rate and they are removed at the same rate. This enables a consistent dwell time to be obtained for every sintered insert.

In some instances, it will be desirable that the individual molded pieces progress through the conveyor tube by gravity and in other instances, they can be forced through the conveyor tube with a positive feed and indexing mechanism. In some occasions, it is more desirable that the conveyor tube be vertical but it will also operate at an inclined angle or horizontally. Vertical and horizontal embodiments are both illustrated and described below.

The present apparatus is therefore summarized as a microwave sintering oven for multiple small pieces. An example is the molding of a drill bit insert which is made of WC and/or PDC in separate layers and which are sintered together to form a unitary device. They are held together by an alloy (primarily formed of cobalt and other high temperature alloys) and are compacted in a small mold. The individual molds are sequentially placed in a conveyor tube and conveyed through a microwave cavity. Heat is created in them. In one embodiment, a preheater is added to raise the temperature of the green molded piece prior to microwave exposure. This helps change the reflectivity, therefore increasing microwave absorption as will be noted. The conveyor tube is provided with a series of individual molds which hold individual work pieces; they progress through it in sequence and are treated thereby having a fixed dwell time sufficient to obtain full sintering. Different techniques are set forth for feeding including gravity feed, operation of an indexing input device, and pushing the mold pieces with a rod inserted into the conveyor tube.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

Figure 1:
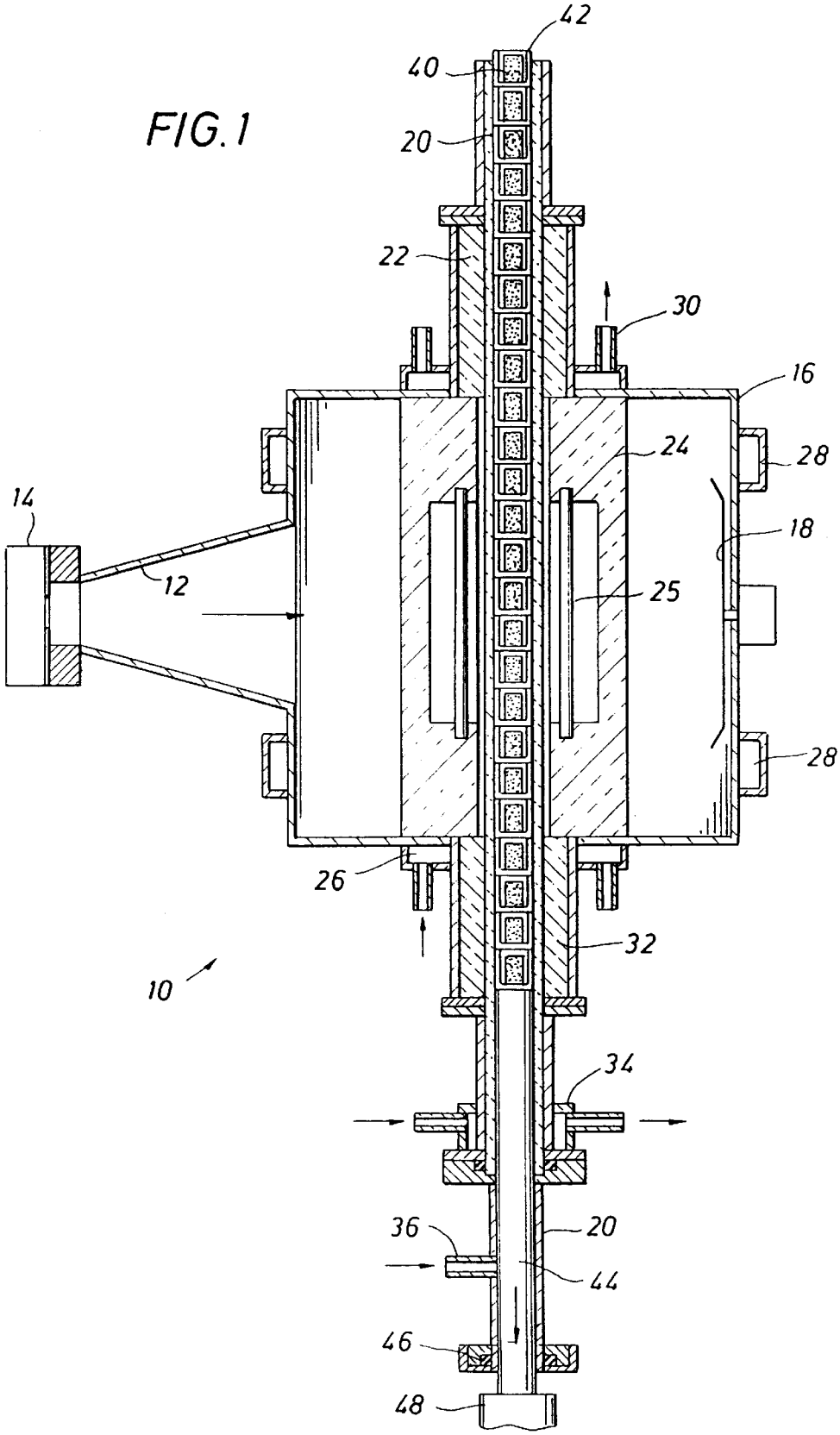
FIG. 1 is a sectional view of the microwave sintering apparatus of the present disclosure which provides for continuous sintering of green work pieces made of ceramics or metals in a microwave field.

Attention is now directed to FIG. 1 of the drawings where the numeral 10 identifies the microwave sintering apparatus of the present disclosure. It incorporates a wave guide 12 which connects to a microwave energy source 14. The source 14 provides a continuous wave (CW) signal which is delivered through the microwave guide into the microwave cavity 16. The cavity 16 has a wall which reflects the microwave energy and keeps it within the cavity. There is a microwave stirring device 18 driven by a motor and which rotates to scatter radiation, thereby creating a continuous change in the microwave pattern. This helps provide more uniform exposure within the microwave cavity. A tube 20 is extended through the cavity 16. The tube 20 is made of ceramic at least partially or fully transparent to the microwave energy. It is typically an elongate hollow round tube. It is preferably round for the products to be described but it can be made rectangular or to any other cross-sectional shape depending on the shape of the product and the molds that are placed in it. As shown in FIG. 1, the hollow ceramic tube inserts through an insulator sleeve 22 which is serially connected to a larger insulator sleeve 24. The sleeves define a central region in the conveyor or transport tube 20, between the two ends, where the temperature is increased by near proximity to the microwave cavity. The microwave cavity is heated substantially by the radiation interacting with the sinter material so that cooling is needed at various locations around the microwave cavity. An optional electric resistance heater wire 25 is located adjacent the tube 20 to preheat or supplement the microwave heating resulting from irradiation of the unsintered particles. A water jacket 26 fits around the cavity in one dimension and another portion thereof is illustrated at 28. Water is introduced at the bottom and flows from an outlet 30 at the top. The conveyor tube 20 extends through a lower insulative sleeve 32. The several insulation sleeves assure that heat is confined within the conveyor tube. This helps provide the proper microwave initiated temperature increase to the particles for sintering. Also, it may be necessary to include an additional cooling jacket 34 on the conveyor tube for subsequent post sintering cooling.

The tube 20 has a specified diameter. It is oversized with respect to the individual molds introduced into it. A gas inlet 36 is shown at the bottom so that gas can be introduced and flows up through the tube. Gas flow upwardly can easily carry a reducing component such as hydrogen along the tube. The gas (having a selected make-up) can optionally react in the sintering process. Gas flows next to the side wall and moves in an annular flow path to exit the elevated end of the tube 20. At the top, the green work pieces 40 are inserted in individual crucibles 42. The crucible or mold shapes the particles to the desired shape. The preferred or target product is an elongate cylindrical body. That is easily formed in the crucible 42 which is defined by a simple hollow cylindrical cavity in a cylindrical body having a removable lid or cover. The green work piece 40 initially has the form of compacted powder. Typically, the compacted particulate material is placed in it first. The particles are put into the mold and include the WC particles and the particles forming the PDC layer of the finished product. Binder particles making up the bonding alloy, primarily cobalt and lesser quantities of other metals, are added. All of these are placed in the crucible 42 in the form of particles. A binder element is often added and usually is a sacrificial wax or other petroleum product. It is a wax which is tacky and solid at room temperature. It preferably has an adequate measure of tackiness so that it holds the particles. When heated, it becomes soft and when heated further, it preferably vaporizes so that the temperature increase while microwave sintering completely expels the sacrificial wax component. The wax is optional in the sense that it is not required in the finished product. It is helpful to hold the loose particles compacted together.

The wax put into the mold 42 holds the components together. They are also tamped to a sufficient packing density that the particles are in intimate contact one with another. They are tamped and slight pressure is applied. So to speak, finger pressure will suffice. Hence, the work piece particles defining the work piece are place in the crucible 42 and this is done so the individual crucible can then be inserted into the conveyor tube 20.

FIG. 1 further includes an elongate push road 44 extending upwardly into the tube 20. A seal 46 is shown at the lower end and permits the rod 44 to be retracted by a suitable power source such as a hydraulic retractor 48. It is desirable that the rod 44 control crucible velocity. It holds up the first crucible inserted into the system. Indeed, FIG. 1 is shown with any number of individual crucibles standing on the rod 44. The rod 44 is a speed control device. It is retracted at a constant rate such as 1 inch per minute. The velocity of the rod retraction can be adjusted. Preferably, the rod has a length which is approximately equal to the transparent conveyor tube 20. It is extended fully into the conveyor tube 20 so that it extends well beyond the microwave cavity 16. A first crucible is then placed on the top end of the rod in the conveyor tube 20. Second and third crucibles are then stacked on it. The conveyor tube is commonly filled from the top. The rod 44 is controllably pulled downwardly. Gravity movement then gradually carries each of the green work pieces 40 into the microwave sintering process, and they move steadily through the microwave cavity 16. At individual work pieces, each is exposed to a build-up in microwave radiation which achieves a maximum in the cavity 16. Then, the microwave energy is decreased for the individual work piece as it leaves the cavity 16 progressing from the top to the bottom of FIG. 1. Each work piece is microwave treated to thereby sinter the particles making up the work piece. Any wax adhesive mixed with the particles is driven off in the form of vapors. Any moisture is also given off as steam. To this end, the crucible 42 is preferably a loosely sealed hollow cylindrical chamber formed of a ceramic material which is partially or fully transparent to the microwave radiation. As the rod is pulled downwardly, the individual work pieces progress steadily downwardly and are removed. The several pass fully through, thereby accomplishing the necessary treatment. This is accomplished while simultaneously controlling the temperature of the microwave cavity 16 by providing a fixed flow of coolant through the jacket around it, and a flow of ventilation gas is introduced through the port 36 and flow out of the top end of the conveyor tube 20. The process begins by insertion of the metal rod 44 fully into the tube. It continues by removing it steadily. The tube 20 is preferably extended in length so that the rod guides all of the individual crucibles until the last has moved down and out of the microwave sintering region in the middle of the cavity. The equipment is then reset by returning the rod 44 to the raised position. Another batch can then be sintered thereafter. Conveniently, the individual crucibles can be recycled and used again.

Figure 2:
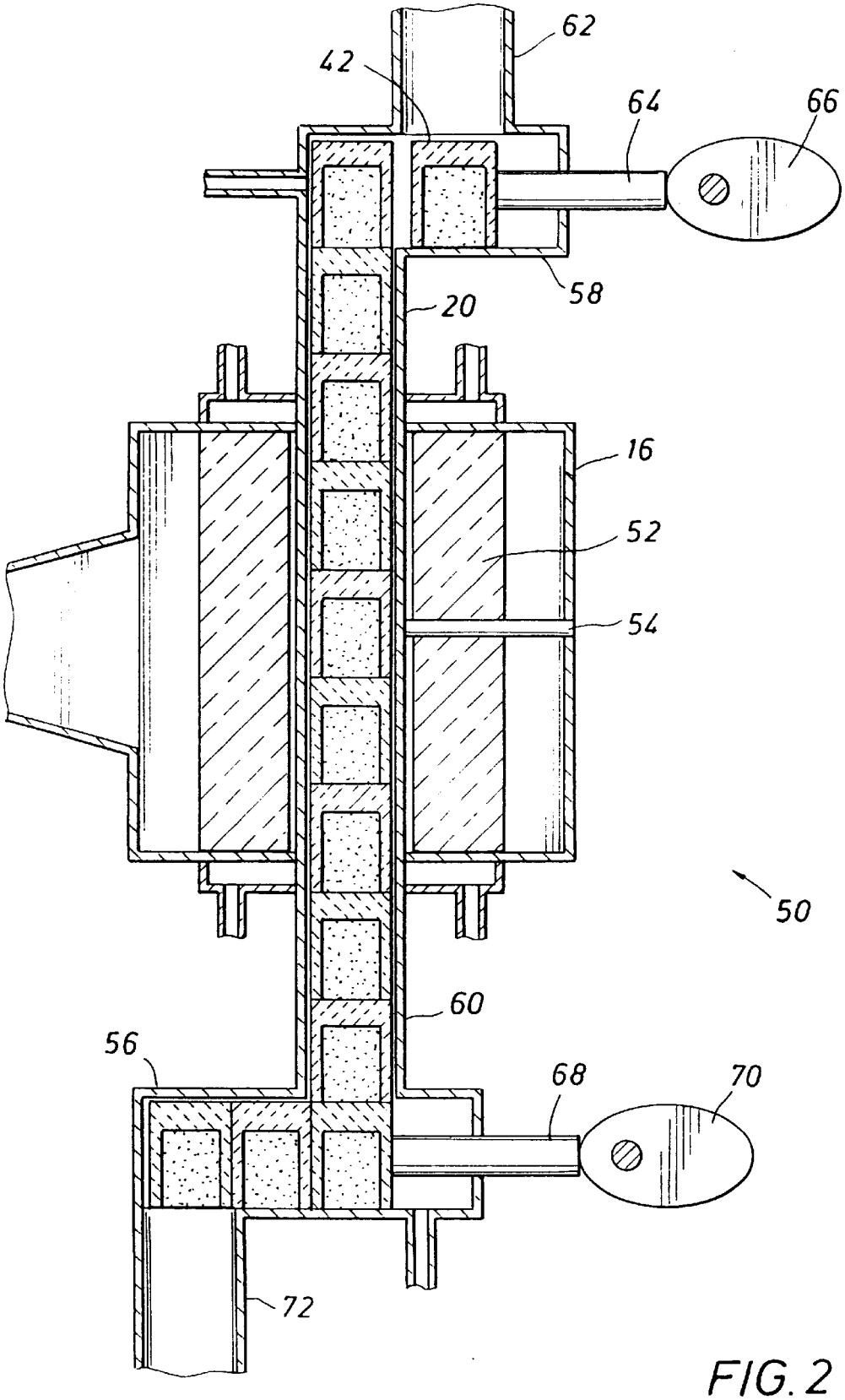
FIG. 2 is an apparatus similar to FIG. 1 showing a conveyor tube for continuous sintering of ceramics in the microwave field which system incorporates a different individual work piece feeding mechanism and indexing device for removal of the individual work pieces.

Going now to FIG. 2 of the drawings, an alternate embodiment 50 is illustrated. This embodiment incorporates the same microwave cavity as before. It is shown with a larger insulator 52 in the cavity, and also includes a temperature probe 54 which extends to the conveyor tube. In this particular instance, the tube 60 is shorter, and has a bend or elbow 58 at the top end along with a similar elbow 56 at the bottom end. The elbows 56 and 58 enable the individual crucibles to be placed in the tube and includes an indexing device which pushes them in or out as the case may be. From the top, a port 62 enables one individual crucible 42 to be dropped into the elbow. An indexing device pushes to the left, and incorporates a push rod 64 driven by a rotating cam lobe 66. That controls the stroke for pushing one crucible to the left. The length of stroke is sufficient to move the crucible 42 from alignment with the port 62 into a centerline position above the tube 20. As shown in the drawing, this equipment is intended for continuous operation, typically around the clock. Individual crucibles are input in the manner just described. When they arrive at the aligned position above the conveyor tube 20, they fall downwardly in the concentric tube. The tube 60 is filled so that it is stacked from the bottom to the top. At the bottom, the bottom most individual crucible is delivered out of the tube 20 adjacent to an indexing mechanism 68. Again, it functions in the manner of a push rod and is operated by a controlled cam lobe 70 which periodically pushes the individual crucible to the left. The indexing rod 68 has a stroke which is only as long as needed to force the crucible one position to the left. The elbow 56 incorporates an outlet port 72 so that the individual crucibles are forced ultimately to the far left and drop downwardly through the port 72. First one and then the next one falls through that port, and each is pushed to that position by operation of the push rod 68.

Consider an example of the sintering time accomplished by the embodiment 50. Assume, for purposes of discussion, that sintering occurs primarily and substantially while the individual work piece 40 is in the cavity 16 shown in FIG. 2. If the cavity, as illustrated in these drawings, has a height spanning approximately five individual crucibles, and it is required that each one spend ten minutes in the microwave cavity, then the system must operate to remove one crucible every two minutes and add a new one at the top end. Once the conveyor tube 20 is filled, each one will dwell in the microwave cavity for the requisite ten minute interval. To illustrate this further, assume that the conveyor tube is filled and that the elbows 56 and 58 are also filled. The push rod 68 is moved to the left, thereby forcing the individual crucible at the far left to fall through the port 72 so that it can be removed because microwave sintering has been completed. The rod 68 is extended and then retracted. After it is retracted, the vertical stack of individual crucibles in the conveyor tube falls downwardly so that one is returned to the position abutting the end of the push rod 68. At this point, the push rod 64 is also operated to push to the left. When it pushes to the left, it moves an individual crucible and the encompassed work piece into the conveyor tube so that it is then standing and supported on the standing column of individual crucibles. After the rod 64 has been retracted, another individual crucible 42 is then dropped through the port 62. This cycle is then repeated to index the next crucible into the system while removing a completed work piece.

Figure 3:
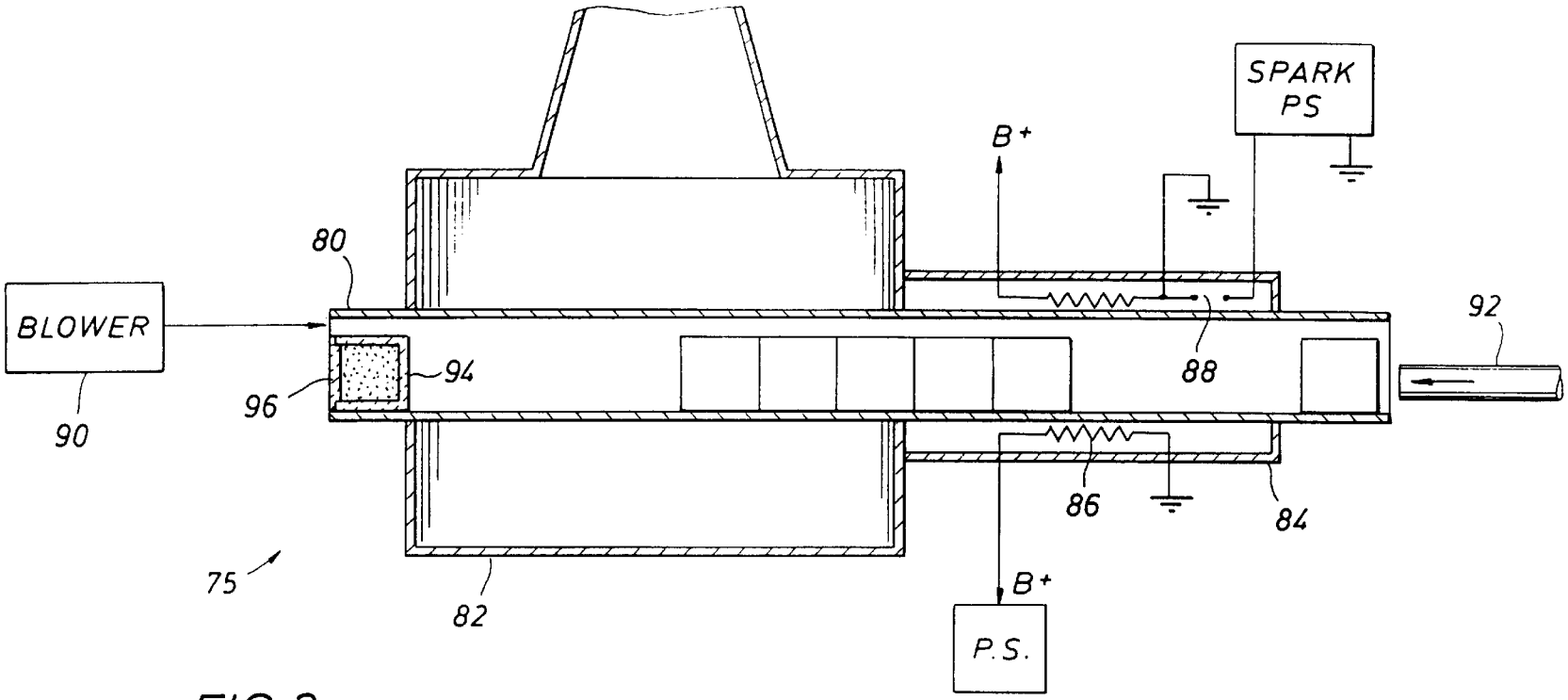
FIG. 3 is another microwave sintering system in which the conveyor tube is horizontal to enable the individual work pieces to be moved through it passing first through a preheater stage which changes the reflectivity of the particles prior to sintering with microwave energy.

FIGS. 1 and 2, taken together, show gravity feed working to advantage in the two different embodiments. FIG. 3 shows another embodiment which does not use a vertical feed. Going to FIG. 3 of the drawings, the numeral 75 illustrates another version which has notable added features. In FIG. 3, the tube 80 passes through the microwave cavity 82. It also passes through a preheater chamber 84. The preheater chamber 84 is provided with $B^+$ voltage for a resistance strip heater 86. A suitable power supply is connected for heating. The preheater cavity optionally also includes a spark gap 88. Periodically, a spark is provided from the spark power supply. The spark jumps through the gap 88 to assure combustion of combustible fumes driven from the wax in the individual crucibles. A blower 90 introduces a flow of air including oxygen from left to right. The spark gap 88 can be omitted and the blower 90 can be provided with nitrogen to avoid combustion and also reduce oxygen near the sintered materials. In many cases, the sintering occurs in an inert atmosphere. The blower 90 forces any of the combustible gas discharged from each crucible to flow to the right. Preferably, they flow into the region of the spark 88 and the spark ignites, thereby combusting any discharge gases. If the discharge rate is somewhat erratic, the spark is applied from the spark power supply repetitively to keep the spark alive so that the combustion continues. As a generalization, the combustion adds some measure of heat which has a value as will be set forth. Again, if inert gases flow along the tube, the spark is omitted and the inert gas flow suppresses any combustion. A push rod 92 at the right hand end controllably forces the individual crucibles with the work pieces in them through the system. Going momentarily to the individual crucible 94, it will be shown to have a removable lid 96. Again, the system is discussed and illustrated in the context of making cylindrical drill bit inserts. The crucible 94 is therefore a cylindrical upstanding hollow chamber with a circular lid having sufficient lip to close. The lip closes at the top, thereby defining a chamber for receiving the particulate materials making up the green work piece. The rod 92 indexes the individual crucibles as they are introduced into the tube 80 and forces them to the left at a controlled rate. They move through the preheater region at 84. Then they move into the microwave cavity 82 and are exposed to microwave energy for sintering.

Consider the impact, however, of the preheater stage upstream of the microwave cavity. As a generalization, if the loose particles requiring sintering are primarily metallic in nature, and that is especially the case in the manufacture of drill bit inserts, they reflect microwave energy. That is especially more severe at ambient temperatures. As the temperature is raised, that characteristic changes with temperature, thereby enabling more energy to be absorbed into the particles. As the temperature goes up, the reflectivity changes sufficiently that sintering can then be accomplished. Thus, a strip heater 86, shown in this embodiment, is incorporated to raise the temperature somewhat but not to the sintering temperature. Sintering typically is accomplished in the range of 1,000° C., and it is not uncommon to operate the microwave sintering device as high as about 1450° C. Focusing, however, on the initial preheating step, the strip heater 86 raises the temperature of the green work pieces from about 20° C. to about 300° C. to 500° C. Then, on entering the microwave cavity 82 at room temperature, the reflectivity is great so that more microwave energy is required. At higher temperature, energy is absorbed into the particles, and a more rapid sintering process is thus accomplished because of improved initial energy absorption. Considering the energy input to the strip heater 86 from the power supply and the energy input from the microwave generator into the cavity 82, this approach is much more rapid and efficient in the use of energy. With external heating in a furnace or the like, greater energy expenditures are incurred and the dwell time is much longer. In this particular instance, there is a net energy savings and the green work pieces are exposed to the energy for a shorter interval. This significantly changes for the better the energy requirements, shortening the actual high temperature interval, and yet providing a better sintered product. Moreover, and especially in the instance of forming the insert with cobalt alloy, the cobalt alloy grains are relatively small. The enhanced operation with the preheater just mentioned enables a more rapid transit time through the microwave cavity. Preheating to 200° C. or more de waxes the green part and relocates the reflectivity/absorption characteristics so much so that dwell time is seriously and significantly improved.

While the foregoing is directed to the preferred embodiment, the structure is determined by the claims which follow.

What is claimed is:

1. A sintering apparatus for green work pieces comprising:

(a) a tube for green work pieces;

(b) a preheater providing heat to green work pieces in said tube;

(c) a microwave cavity cooperating with said tube so that preheated green work pieces are microwave sintered in said cavity by microwave energy after preheating; and (d) a transport for moving green work pieces along said tube over a timed interval for preheating and microwave sintering.

2. The apparatus of claim 1 wherein said tube is vertical so that said work pieces move along said tube at gravity urging.

3. The apparatus of claim 1 wherein said tube is vertical and including a rod in said tube comprising said transport, and said rod moves said work pieces over time for sintering exposure.

4. The apparatus of claim 1 wherein said tube is vertical, and said transport comprises a rod in said tube, and said rod is indexed to move individual work pieces over said timed interval in said tube through said cavity for sintering, and wherein said rod periodically operates to remove one work piece from said tube to enable other work pieces to move sequentially in said tube.

5. The apparatus of claim 4 wherein said rod moves to eject said one work piece from said tube and said ejected work piece is ejected through an ejection opening.

6. The apparatus of claim 5 wherein said tube connects to an elbow and lateral tube from said elbow to enable lateral tube ejection to said ejection opening.

7. The apparatus of claim 1 wherein said transport comprises:

(a) a loading passage opening into a tube portion connected to said tube, and defining a work piece delivery system for said tube inlet;

(b) a lateral tube ejection port connected from said tube and comprising said outlet end;

(d) a periodically operated work piece moving index mechanism for clearing one work piece from said outlet end; and (e) a periodically operated work piece moving index mechanism for aligning one work piece with said tube.

8. The apparatus of claim 1 wherein said tube is level and said transport comprises a push member moving toward said tube to push work pieces there along.

9. The apparatus of claim 8 wherein said tube has an inlet end for receiving one and then a second work piece therein, and said push member comprising a tube aligned push rod.

10. The apparatus of claim 1 including a blower directing a gas flow into said tube.

11. The apparatus of claim 10 wherein the gas reacts in the sintering.

12. The apparatus of claim 1 wherein said preheater comprises a heater adjacent to said tube to provide radiant heat.

13. The apparatus of claim 1 wherein said preheater forms heat to raise the temperature of work pieces sufficiently so that said preheater changes the microwave absorption of metallic, unsintered particles.

14. The apparatus of claim 1 wherein said tube is sufficiently transparent to microwave radiation and enables work pieces to be first preheated and said transport times work pieces exposure to said preheater.

15. A method of sintering metallic particles into a finished body wherein the particles are reflective to microwave radiation at ambient temperatures comprising the steps of:

(a) placing metallic particles on a path to move through a sintering process;

(b) preheating the particles to raise the particles to an elevated and intermediate temperature selected so that said particles are less reflective to microwave radiation;

(c) after preheating then heating said particles in microwave radiation to a temperature and for an interval to sinter the particles into a finished body.

16. The method of claim 15 including the preliminary step of preheating in a mold having a shape defining the finished body.

17. The method of claim 15 including preliminary step of shaping the metallic particles to a finished shape held together by a sacrificial adhesive.

18. The method of claim 15 wherein said path is defined by a tube sufficiently transparent to radiant heat and also to microwave energy, and including the step of moving the particles serially and at a time rate through said tube for preheating and then sintering.

19. The method of claim 18 including the step of periodically indexing the particles in a mold moved as a unit having a defined shape for sintering to a desired shape.

20. The apparatus of claim 1 further comprising a cooling jacket for post sintering cooling of said work pieces.

21. The method of claim 18 comprising the additional step of positioning said tube so that said particles move along said tube at gravity urging.

22. The method of claim 18 comprising the additional steps of:

(a) providing a rod in said tube; and (b) moving said particles through said tube serially and at said timed rate by means of said rod.

23. The method of claim 18 comprising the additional step of directing a gas flow into said tube.

24. The method of claim 23 wherein gas in said gas flow reacts in the sintering.

* * * * *